US010408007B2

(12) United States Patent
von Gynz-Rekowski et al.

(10) Patent No.: US 10,408,007 B2
(45) Date of Patent: Sep. 10, 2019

(54) DOWNHOLE EXTENDED REACH TOOL AND METHOD

(71) Applicant: Rival Downhole Tools LC, Houston, TX (US)

(72) Inventors: Gunther HH von Gynz-Rekowski, Montgomery, TX (US); Russell Koenig, Conroe, TX (US); Michael V. Williams, Conroe, TX (US); Kevin J. Rudy, Conroe, TX (US)

(73) Assignee: Rival Downhole Tools LC, Houston, TX (US)

( * ) Notice: Subject to any disclaimer, the term of this patent is extended or adjusted under 35 U.S.C. 154(b) by 167 days.

(21) Appl. No.: 15/408,589

(22) Filed: Jan. 18, 2017

(65) Prior Publication Data

US 2017/0204693 A1 Jul. 20, 2017

Related U.S. Application Data

(60) Provisional application No. 62/280,213, filed on Jan. 19, 2016.

(51) Int. Cl.
*E21B 28/00* (2006.01)
*E21B 34/14* (2006.01)
(Continued)

(52) U.S. Cl.
CPC ..... *E21B 28/00* (2013.01); *E21B 7/046* (2013.01); *E21B 7/24* (2013.01); *E21B 21/08* (2013.01);
(Continued)

(58) Field of Classification Search
None
See application file for complete search history.

(56) References Cited

U.S. PATENT DOCUMENTS 4,319,240 A * 3/1982 Stone ..... E21B 47/187 175/40
5,156,223 A 10/1992 Hipp
(Continued)

FOREIGN PATENT DOCUMENTS

CA 2836182 6/2014

OTHER PUBLICATIONS

International Search Report and Written Opinion dated Apr. 5, 2017 from applicant's counterpart International Patent Application No. PCT/US2017/13889.

*Primary Examiner* — Shane Bomar
(74) *Attorney, Agent, or Firm* — Jones Walker LLP

(57) ABSTRACT

A downhole tool includes a valve assembly and a shock absorbing assembly. The valve assembly includes a valve spring operatively connected to a valve body. The shock absorbing assembly includes a spring operatively connected to a shock absorbing body having a fluid passage therethrough. The valve body is configured to selectively engage the shock absorbing body to create a fluid tight seal over the fluid passage in a first position, and to allow a fluid flow through the fluid passage in a second position. The repeated movement cycle of the selective engagement between the valve body and the shock absorbing body generates a pressure pulse or a varying pressure differential across the downhole tool. The repeated movement cycle is powered by a fluid flow. The tool may be selectively activated and deactivated.

19 Claims, 14 Drawing Sheets

(51) Int. Cl.

| | |
|---|---|
| ***E21B 47/18*** | (2012.01) |
| ***E21B 7/04*** | (2006.01) |
| ***E21B 21/08*** | (2006.01) |
| ***E21B 34/08*** | (2006.01) |
| ***E21B 34/10*** | (2006.01) |
| ***E21B 7/24*** | (2006.01) |

(52) U.S. Cl.
CPC ..... *E21B 34/08* (2013.01); *E21B 34/10* (2013.01); *E21B 34/14* (2013.01); *E21B 47/18* (2013.01)

(56) References Cited

U.S. PATENT DOCUMENTS

| | | | | |
|---|---|---|---|---|
| 6,062,324 | A | 5/2000 | Hipp | |
| 6,502,638 | B1 | 1/2003 | Stoesz | |
| 6,571,870 | B2 * | 6/2003 | Zheng | E21B 4/18 166/177.6 |
| 6,866,104 | B2 | 3/2005 | Stoesz et al. | |
| 2005/0178558 | A1 * | 8/2005 | Kolle | E21B 47/14 166/373 |
| 2006/0237187 | A1 | 10/2006 | Stoesz | |
| 2009/0266612 | A1 | 10/2009 | Allahar et al. | |
| 2010/0200244 | A1 | 8/2010 | Purkis | |
| 2013/0286787 | A1 * | 10/2013 | Kolle | G01V 1/133 367/143 |
| 2014/0048283 | A1 | 2/2014 | Mohon et al. | |
| 2015/0107904 | A1 | 4/2015 | Kerstetter | |
| 2017/0030166 | A1 * | 2/2017 | Shen | E21B 41/0085 |

* cited by examiner

DOWNHOLE EXTENDED REACH TOOL AND METHOD

CROSS-REFERENCE TO RELATED APPLICATIONS

This application claims the benefit of and priority to U.S. Provisional Patent Application No. 62/280,213, filed on Jan. 19, 2016, which is incorporated herein by reference.

BACKGROUND OF THE DISCLOSURE

In the process of drilling a wellbore, frictional forces acting against the drill pipe or other component running through the wellbore limit the maximum length or depth to which the wellbore may be drilled. Conventional methods of drilling achieve lengths of 10,000 to 15,000 feet.

Prior art solutions include mechanisms for vibrating the drill pipe during drilling in order to convert static frictional forces on the drill pipe to dynamic frictional forces between the drill pipe and the wall of the wellbore. One method of vibrating drill pipe within a wellbore includes using a valve in the drill string to create a pressure pulse in conjunction with a shock sub. The pressure pulse causes the shock sub to stretch and the drill pipe to vibrate axially, which allows the drill pipe to reach greater lengths or depths within the wellbore. Certain prior art pressure pulse generation tools use a separate power section to activate the valve. These tools, however, use elastomers that are sensitive to heat and chemicals in drilling mud. Other prior art tools use poppet valves that move up and down to open and close fluid ports. These poppet valve tools, however, are very complicated and cannot be used with drilling mud containing any kind of solids. Furthermore, conventional vibrating tools and methods provide vibration during the entire duration of drilling, i.e., from beginning of pumping drilling fluid through the drill pipe and vibration tool. The constant vibration places undue wears on the vibration tool resulting in reduce longevity.

SUMMARY OF THE DISCLOSURE

The disclosure provides an embodiment of a downhole tool. The tool may include a valve assembly. The valve assembly may include a valve spring operatively connected to a valve body. The tool may also include a shock absorbing assembly. The shock absorbing assembly may include a spring operatively connected to a shock absorbing body having a fluid passage therethrough. In the tool, the valve body may be configured to selectively engage the shock absorbing body to create a fluid tight seal over the fluid passage in a first position and to allow a fluid flow through the fluid passage of the shock absorbing body in a second position. Also in the tool, the selective engagement of the valve body and the shock absorbing body may generate a varying pressure differential across the downhole tool.

In an embodiment, the downhole tool may include a dampener operatively connected to the shock absorbing body for controlling a movement speed of the shock absorbing body. The dampener may comprise a first chamber, a second chamber, and an interconnecting conduit. The interconnecting conduit may comprise an annular space or an aperture.

In another embodiment, the downhole tool may include a stop mechanism for limiting a movement of the valve body. The stop mechanism may comprise a shoulder configured to engage a portion of the valve body.

In another embodiment, the downhole tool may include a housing. The valve assembly and the shock absorbing assembly may be disposed within the housing. The shock absorbing body may comprise a piston.

In another embodiment, the downhole tool's valve body may include a valve stem extending to a valve plunger. The valve plunger may be configured to engage the shock absorbing body to seal the fluid passage in the first position.

In another embodiment, the downhole tool's valve spring may be disposed around the valve stem and a stop sleeve may be disposed between the valve spring and the valve stem for limiting the compression of the valve spring.

In another embodiment, the downhole tool's valve plunger may include a guide protrusion. The guide protrusion may at least partially be disposed within the fluid passage of the shock absorbing body in the first position.

The disclosure also provides an embodiment of a method of generating a pressure pulse in a tubular disposed within a wellbore. The method may include the step of providing a downhole tool positioned in line with the tubular. The downhole tool may comprise a spring-loaded valve body and a shock absorbing system. The method may include the step of flowing a fluid through the tubular and into the downhole tool. The method may include the step of generating a pressure pulse with the downhole tool using the flow of the fluid to repeatedly move the valve body from a first position to a second position. The fluid may be prevented from flowing through the fluid passage in the first position, and may be allowed to flow through a fluid passage of the shock absorbing system in the second position.

The disclosure provides another embodiment of a method of generating a pressure pulse in a tubular disposed within a wellbore. The method may comprise the step of providing a downhole tool positioned in line with the tubular. The downhole tool may comprise a spring-loaded valve body and a mechanical device. The method may include the step of flowing a fluid through the tubular and into the downhole tool. The method may include the step of opening the valve body with a hydraulic energy of the flow of the fluid. The method may include the step of displacing the mechanical device and storing energy in the mechanical device. The method may include the step of using the stored energy to return the mechanical device to its original position and to close the valve body.

The disclosure provides another embodiment of a method of generating a pressure pulse in a tubular disposed within a wellbore. The method may comprise the step of providing an extended reach tool in a downhole assembly of the tubular. The extended reach tool may comprise: a valve assembly including a valve spring operatively connected to a valve body, and a shock absorbing assembly including a spring operatively connected to a shock absorbing body having a fluid passage therethrough. The valve body may be configured to selectively engage the shock absorbing body to create a fluid tight seal over the fluid passage in a first position and to allow a fluid flow through the fluid passage in a second position. The method may include the step of flowing a fluid through the tubular and into the extended reach tool. The method may include the step of generating a pressure pulse in the tubular with the extended reach tool with a repeated movement cycle of the valve body and the shock absorbing body between the first position and the second position. The flow of the fluid through the extended reach tool may power the repeated movement cycle.

In another embodiment of the method, each movement cycle includes the step of allowing the flow of the fluid to move the valve body and the shock absorbing body in a first direction while maintaining the fluid tight seal of the first position, thereby compressing the valve spring and compressing the spring associated with the shock absorbing body. Each movement cycle may also include the step of allowing the shock absorbing body to continue moving in the first direction when the valve body stops moving in the first direction to allow the fluid to flow through the fluid passage of the shock absorbing body. Each movement cycle may also include the step of allowing the valve spring to move the valve body in a second direction opposite the first direction, and allowing the spring that is operatively connected to the shock absorbing body to move the shock absorbing body in the second direction. Each movement cycle may also include the step of allowing the valve body and the shock absorbing body to return to the first position.

In another embodiment, the method may include the step wherein the valve body stops moving in the first direction when the valve spring reaches a force equilibrium between a spring force of the valve spring and hydraulic forces acting on the valve body that are created by a pressure drop over one or more apertures in the valve body.

In another embodiment the method may include the step wherein the valve body stops moving in the first direction when a stop mechanism is engaged.

In another embodiment, the method may include the step wherein the extended reach tool further comprises a dampener operatively connected to the shock absorbing body, and wherein the dampener causes the shock absorbing body to move in the second direction at a slower rate than the rate of movement of the valve body in the second direction.

The disclosure provides an embodiment of a method of drilling a wellbore. The method may comprise the step of providing an extended reach tool in a downhole assembly of the tubular. The extended reach tool may comprise: a valve assembly including a valve spring operatively connected to a valve body, and a shock absorbing assembly including a spring operatively connected to a shock absorbing body having a fluid passage therethrough. The valve body may be configured to selectively engage the shock absorbing body to create a fluid tight seal over the fluid passage in a first position and to allow a fluid flow through the fluid passage in a second position. The extended reach tool may be configured to provide a vibration action in an activated state and to discontinue the vibration action in a deactivated state. The method may include the step of attaching the extended reach tool to a tubular and a drill bit. The method may include the step of lowering the extended reach tool and the tubular into a wellbore. The method may include the step of drilling the wellbore with the drill bit. The method may include the step of providing a first signal to the extended reach tool to place the extended reach tool in the activated state, thereby vibrating the tubular.

In another embodiment, the method may include the step of wherein providing the first signal includes increasing a flow rate of a drilling fluid through the extended reach tool to exceed a threshold value to place the extended reach tool in the activated state.

In another embodiment, the method may include the step of wherein providing the first signal includes increasing a rotary speed of the tubular to exceed a threshold value to place the extended reach tool in the activated state.

In another embodiment, the method may include the step of wherein providing the first signal includes pumping a body through the extended reach tool. The body may cooperate with a receptacle to place the extended reach tool in the activated state.

In another embodiment, the method may include the step wherein providing the first signal includes pumping an RFID unit through the extended reach tool. A control unit of the extended reach tool may sense the presence of the RFID unit and place the extended reach tool in the activated state.

In another embodiment, the method may include the step of wherein providing the first signal includes providing a pressure pulse, a hydraulic signal, or an electronic signal to place the extended reach tool in the activated state.

In another embodiment, the method may include the step of providing a second signal to the extended reach tool to place the extended reach tool in the deactivated state, thereby discontinuing the vibration of the tubular.

In another embodiment, the method may include the step of wherein providing the first signal includes increasing a flow rate of a drilling fluid through the extended reach tool to exceed a threshold value to place the extended reach tool in the activated state and wherein providing the second signal includes decreasing the flow rate of the drilling fluid through the extended reach tool to below the threshold value to place the extended reach tool in the deactivated state.

In another embodiment, the method includes the step of wherein providing the first signal includes increasing a rotary speed of the tubular to exceed a threshold value to place the extended reach tool in the activated state and wherein providing the second signal includes decreasing the rotary speed of the tubular to below the threshold value to place the extended reach tool in the deactivated state.

In another embodiment, the method may include the step of wherein providing the first signal includes pumping a body through the extended reach tool, wherein the body cooperates with a receptacle to place the extended reach tool in the activated state, and wherein providing the second signal includes pumping a second body through the extended reach tool, wherein the second body cooperates with the receptacle to place the extended reach tool in the deactivated state.

In another embodiment, the method may include the step of wherein providing the first signal includes pumping an RFID unit through the extended reach tool, wherein a control unit of the extended reach tool senses the presence of the RFID unit and places the extended reach tool in the activated state and wherein providing the second signal includes pumping a second RFID unit through the extended reach tool. The control unit of the extended reach tool may sense the presence of the second RFID unit and place the extended reach tool in the deactivated state.

In another embodiment, the method may include the step of wherein providing the first signal includes providing a pressure pulse, a hydraulic signal, or an electronic signal to place the extended reach tool in the activated state and wherein providing the second signal includes providing a second pressure pulse, a second hydraulic signal, or a second electronic signal to place the extended reach tool in the deactivated state.

In another embodiment, the method may include the step of wherein the tubular is a drill string or coiled tubing.

DETAILED DESCRIPTION OF THE PREFERRED EMBODIMENTS

Figure 1:
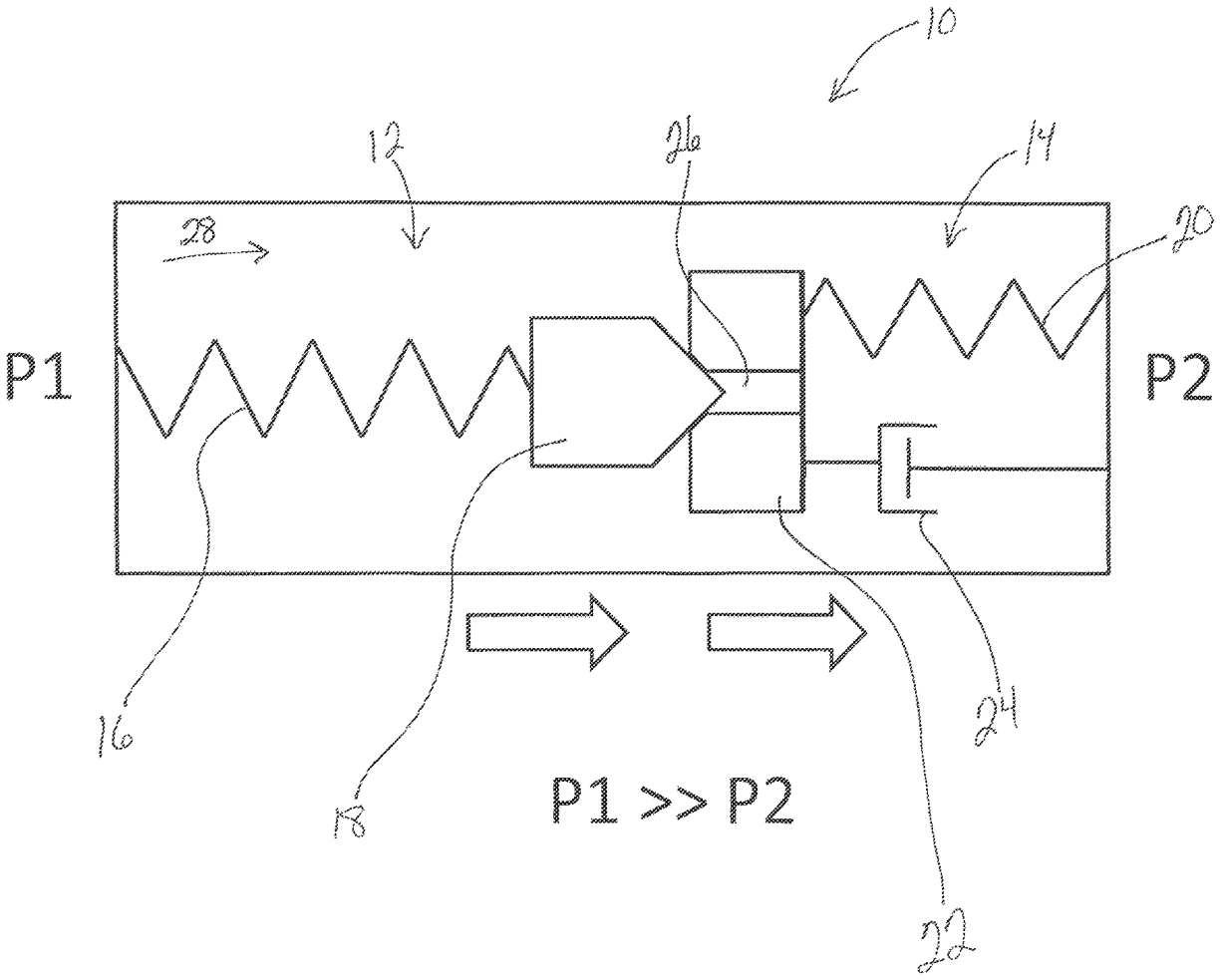
FIG. 1 is a schematic view of an extended reach tool including a valve system and a shock absorbing system in a closed position.
Figure 2:
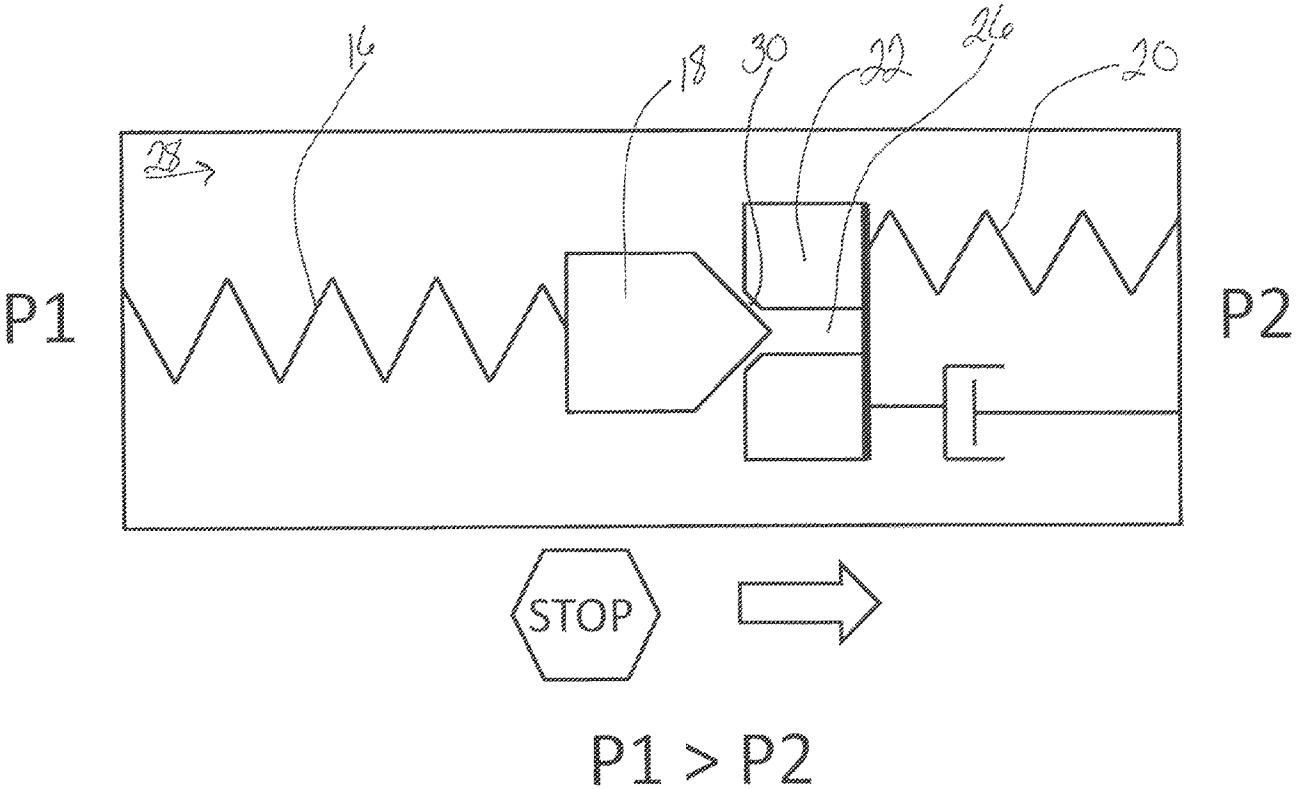
FIG. 2 is a sequential schematic view of the extended reach tool in a partially open position.
Figure 3:
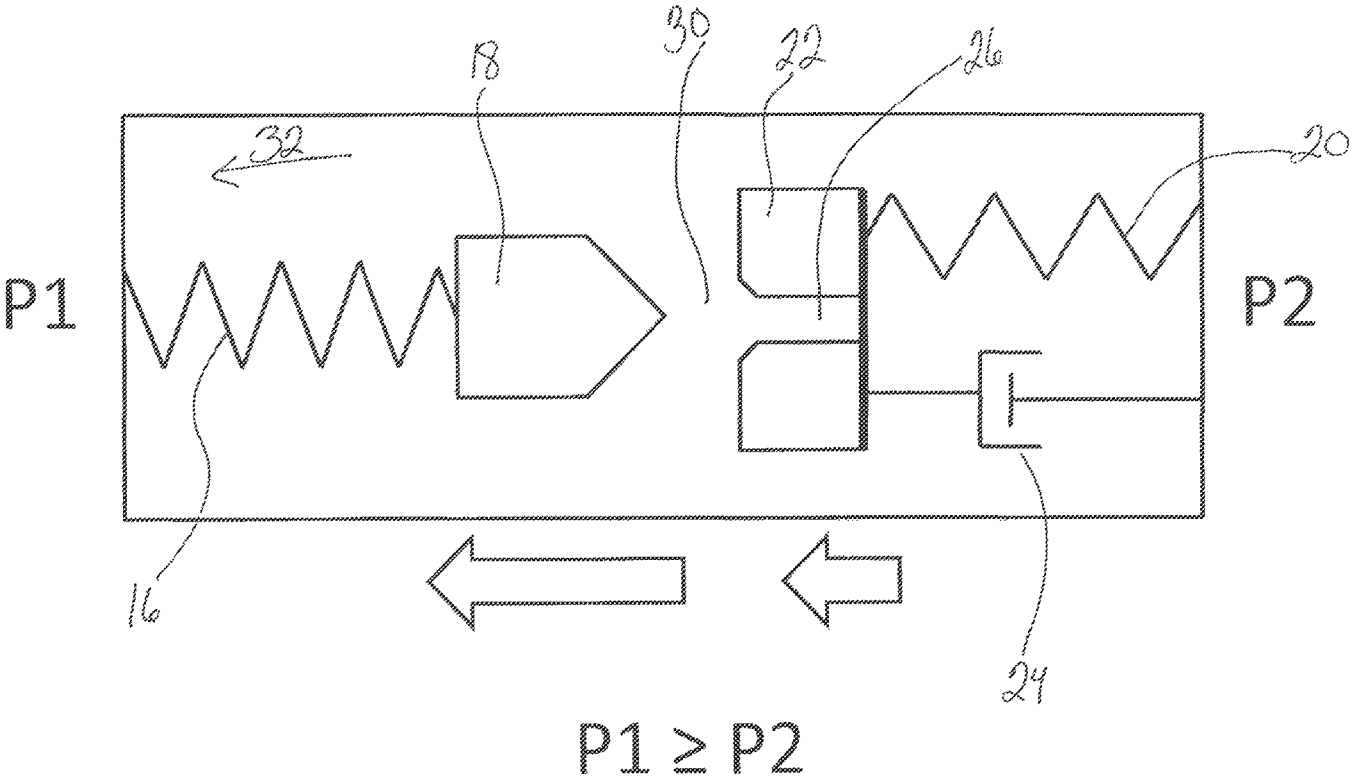
FIG. 3 is a sequential schematic view of the extended reach tool in an open position.

With reference to FIGS. 1-3, extended reach tool 10 may include valve assembly 12 and shock absorbing assembly 14. Valve assembly 12 may include valve spring element 16 and valve body 18. Valve spring element 16 may include a coil spring or any other mechanism for storing energy. Shock absorbing assembly 14 may include shock absorbing spring element 20, shock absorbing body 22, and dampener 24. Shock absorbing spring element 20 may include a coil spring or any other mechanism for storing energy. Dampener 24 may be formed of any mechanism for slowing the movement of shock absorbing body 22, such as a reservoir or cavities configured to communicate fluid through a restriction plate, nozzle, annulus, or other type of orifice. In one embodiment, tool 10 may be used without dampener 24. Shock absorbing body 22 may include fluid passage 26 configured to allow fluid flow through shock absorbing body 22. It should be noted that the illustrated components of tool 10 in FIGS. 1-3 are symbolic representations and do not limit the structural embodiments of each component.

P1 represents a fluid pressure value at a location upstream of tool 10. P2 represents a fluid pressure value at a location downstream of tool 10. The difference between P1 and P2 may be referred to as a pressure differential across tool 10. P1, P2, and the pressure differential may change over time during the movement cycle of tool 10 as described below.

FIG. 1 illustrates tool 10 in a closed position with valve body 18 contacting shock absorbing body 22 to create a fluid tight seal that prevents fluid from flowing through fluid passage 26 of shock absorbing body 22. As a fluid flows in first direction 28 through tool 10 in the closed position, P1 increases and the pressure differential between P1 and P2 increases. Valve body 18 and shock absorbing body 22 are moved in first direction 28, thereby compressing or expanding valve spring element 16 (depending on the attachment configuration of valve spring element 16) and compressing shock absorbing spring element 20. Valve spring element 16 and shock absorbing spring element 20 store energy as they are compressed or expanded.

Valve spring element 16 will stop the movement of valve body 18 as illustrated in FIG. 2 when valve spring element 16 reaches a force equilibrium between its spring forces and hydraulic forces due to a pressure drop over one or more orifices in valve body 18. At this time, shock absorbing body 22 continues moving in first direction 28, thereby creating an opening referred to as space 30 between valve body 18 and shock absorbing body 22. This may be referred to as a partially open position of tool 10. The fluid flowing through tool 10 may begin to flow through space 30 and fluid passage 26 of shock absorbing body 22. In this way, P1 and the pressure differential both begin to decrease.

Compressed or expanded valve spring element 16 then pushes or pulls valve body 18 in second direction 32 (shown in FIG. 3), expanding space 30 between valve body 18 and shock absorbing body 22. P1 and the pressure differential both continue to decrease during this time.

Once shock absorbing spring element 20 is compressed to its defined compression limit shock absorbing spring element 20 will force shock absorbing body 22 to begin moving in second direction 32 as illustrated in FIG. 3. Shock absorbing body 22 will move in second direction 32 at a slower rate than that of valve body 18 due to dampener 24 of shock absorbing system 14. Once valve spring element 16 and the valve body 18 stop moving in second direction 32, valve body 18 contacts the shock absorbing body 22 to create the fluid tight seal. In this way, the valve of tool 10 is closed again. Valve body 18 and shock absorbing body 22 then move in first direction 28 again. Dampener 24 allows optimization of the time that space 30 is open and closed for allowing fluid flow through fluid passage 26 of shock absorbing body 22. Valve spring element 16 functions to allow movement of valve body 18 in first direction 28 and second direction 32. In one embodiment, valve spring element 16 may be compressed when valve body 18 moves in first direction. In another embodiment, valve spring element 16 may be expanded when valve body 18 moves in first direction.

Figure 4:
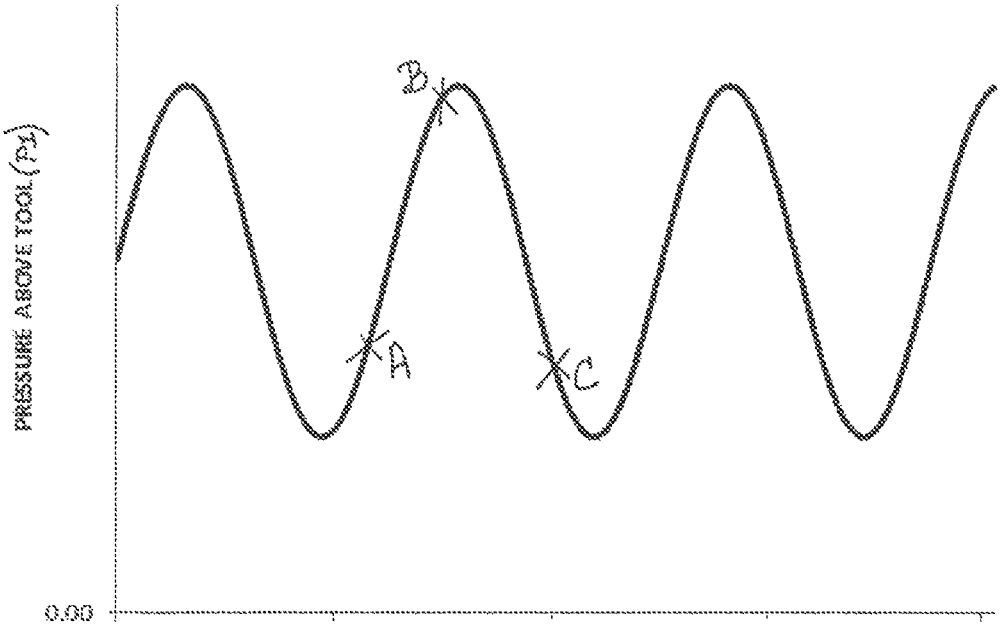
FIG. 4 is a graph of the fluctuation in a pressure upstream of the extended reach tool (i.e., P1 in FIGS. 1-3) over time during a movement cycle of the tool.

FIG. 4 illustrates the variation of P1 during the movement cycle of tool 10 described above in connection with FIGS. 1-3. Point A on the graph illustrates P1 in FIG. 1. P1 increases when tool 10 is in the closed position. Valve body 18 and shock absorbing body 22 are moving in first direction 28 at Point A. Point B on the graph illustrates P1 in FIG. 2. P1 is at its maximum when valve body 18 stops moving in first direction 28. When space 30 is opened, P1 begins to decrease. Point C on the graph illustrates P1 in FIG. 3. P1 continues decreasing as long as tool 10 is in the open position. Valve body 18 and shock absorbing body 22 are moving in second direction 32 at Point C.

Figure 5:
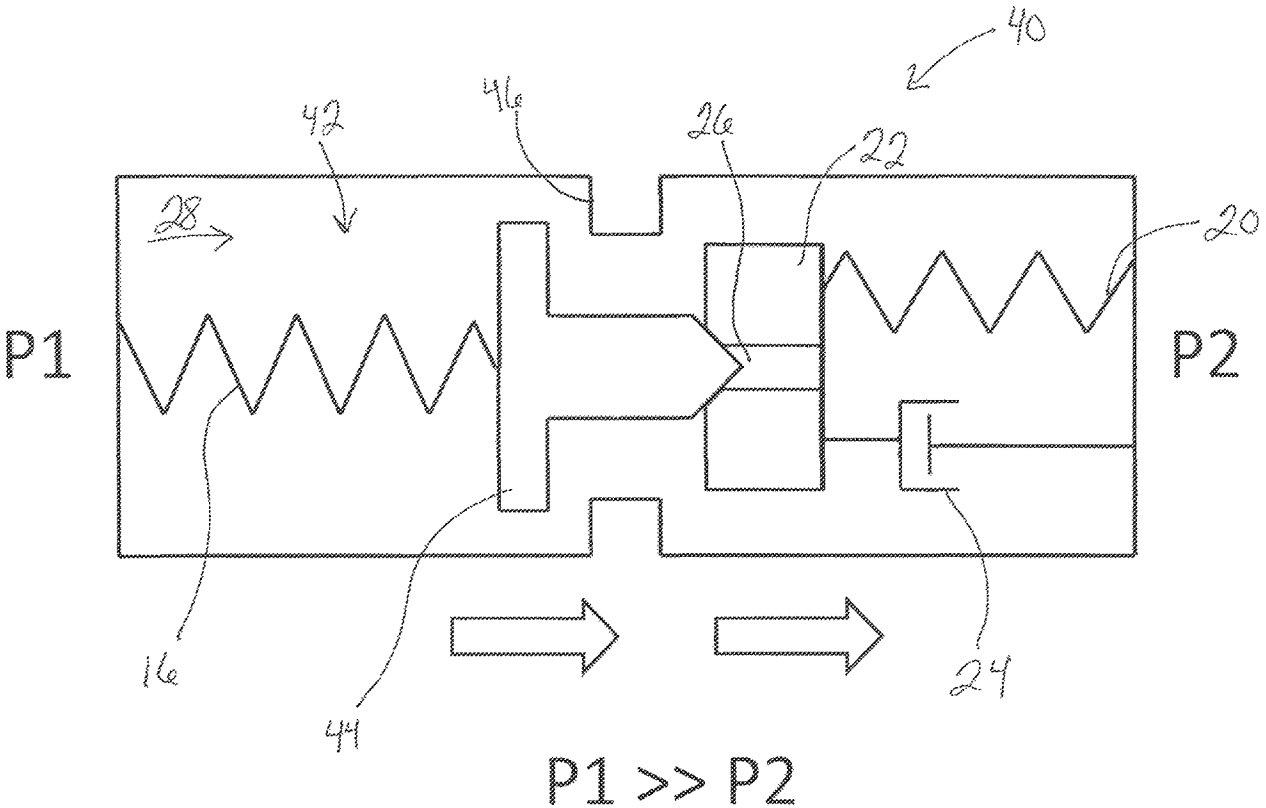
FIG. 5 is a schematic view of an alternate extended reach tool including a stop mechanism for limiting the movement of the valve system, with the tool in a closed position.
Figure 6:
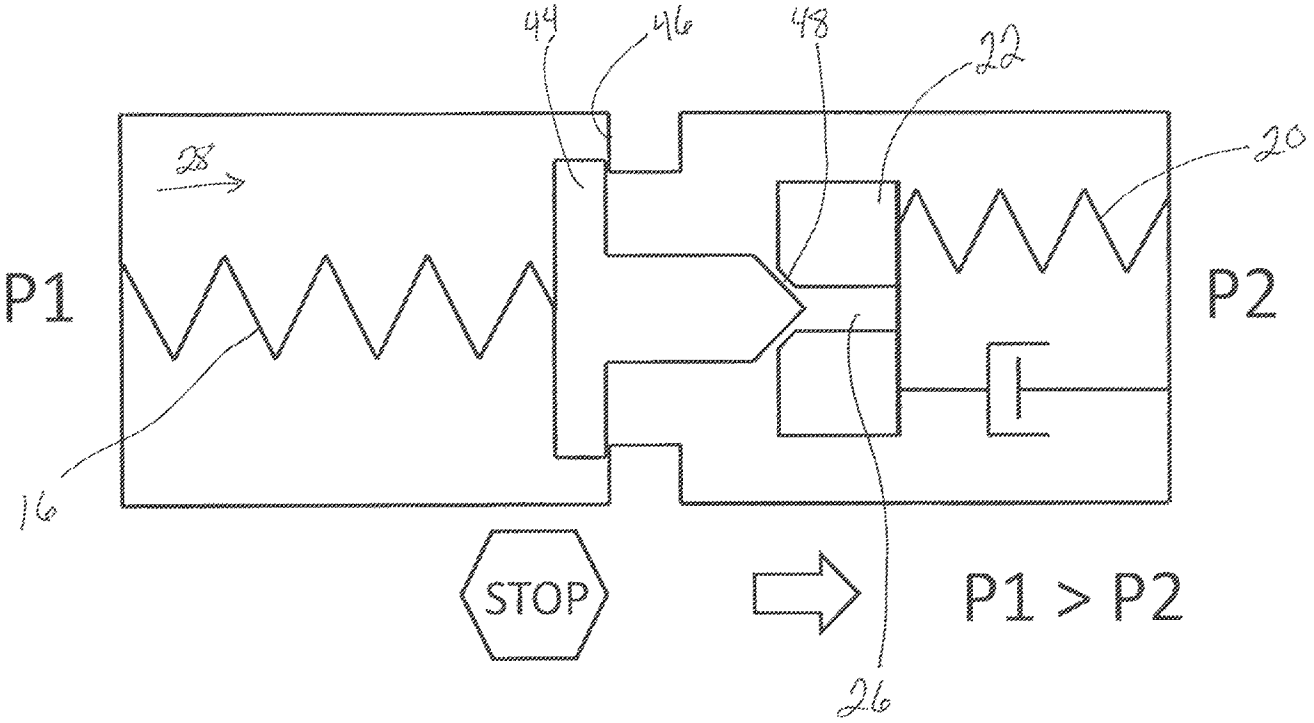
FIG. 6 is a sequential schematic view of the alternate extended reach tool in a partially open position.
Figure 7:
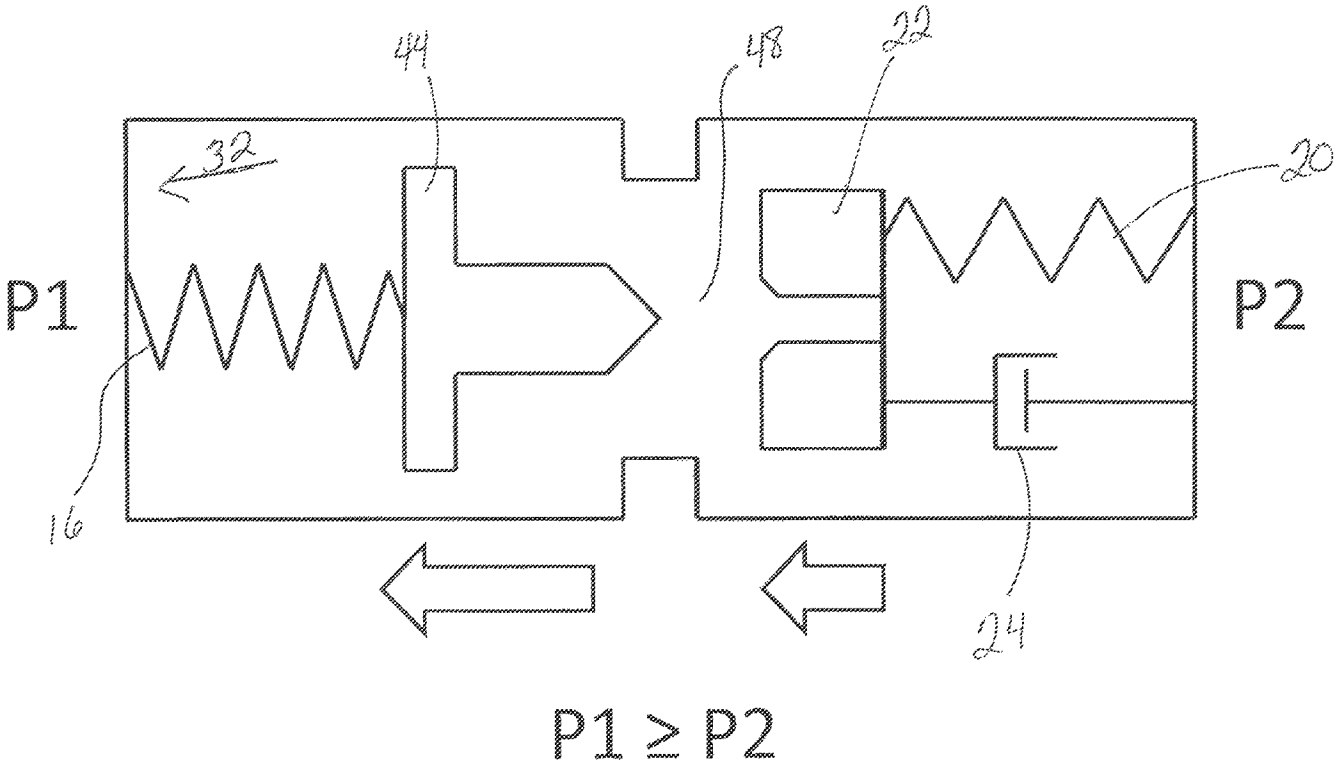
FIG. 7 is a sequential schematic view of the alternate extended reach tool in an open position.

FIGS. 5-7 illustrate the movement cycle of extended reach tool 40, which may include valve assembly 42 having valve spring element 16 and valve body 44. Tool 40 may include a stop mechanism for stopping the movement of valve body 44 in first direction 28. In one embodiment, tool 40 may include stop mechanism 46 configured to engage and stop movement of valve body 44, such as the cooperating shoulder arrangement illustrated in FIGS. 5-7. Tool 40 may include any other stop mechanism capable of stopping the movement of valve body 44, such as a mechanical mechanism, a magnetic mechanism, an electronic mechanism, or a hydraulic mechanism. Extended reach tool 40 including stop mechanism 46 may be useful in applications involving high hydraulic energy, such as use of drilling mud in drilling a wellbore. Extended reach tool 40 may include the same components as tool 10 except as otherwise noted. It should be noted that the illustrated components of tool 40 in FIGS. 5-7 are symbolic representations and do not limit the structural embodiments of each component.

FIG. 5 illustrates tool 40 in the closed position with valve body 44 contacting shock absorbing body 22 such that fluid is prevented from flowing through fluid passage 26 of shock absorbing body 22. As fluid flows in first direction 28 through tool 10 in the closed position, P1 and the pressure differential between P1 and P2 begin to increase. Valve body 44 and shock absorbing body 22 are moved in first direction 28, thereby compressing or expanding valve spring element 16 (depending on the attachment configuration of valve spring element 16) and compressing shock absorbing spring element 20. Valve spring element 16 and shock absorbing spring element 20 store energy as they are compressed or expanded.

Referring to FIG. 6, valve body 44 stops moving in first direction 28 when it contacts stop mechanism 46. An opening referred to as space 48 is created when shock absorbing body 22 continues moving in first direction 28 away from valve body 44 when it is stopped. The fluid flowing through tool 40 may begin to flow through space 48 and fluid passage 26 of shock absorbing body 22. In this way, P1 and the pressure differential between P1 and P2 both begin to decrease.

Compressed or expanded valve spring element 16 then pushes or pulls valve body 44 in second direction 32 (shown in FIG. 7), expanding space 48. P1 and the pressure differential between P1 and P2 both continue to decrease during this time.

Once shock absorbing spring element 20 is compressed to its defined compression limit, spring element 20 forces shock absorbing body 22 to begin moving in second direction 32 as illustrated in FIG. 7. Shock absorbing body 22 moves in second direction 32 at a slower rate than that of valve body 44 due to dampener 24. Once valve spring element 16 reaches its lessened position and valve body 44 stops moving in second direction 32, shock absorbing body 22 contacts valve body 44 to form the fluid tight seal of the closed position. Thereafter, shock absorbing body 22 and valve body 44 move in first direction 28 again. Dampener 24 allows optimization of the time that space 48 is open and closed for allowing fluid flow through fluid passage 26 of shock absorbing body 22.

Figure 8A:
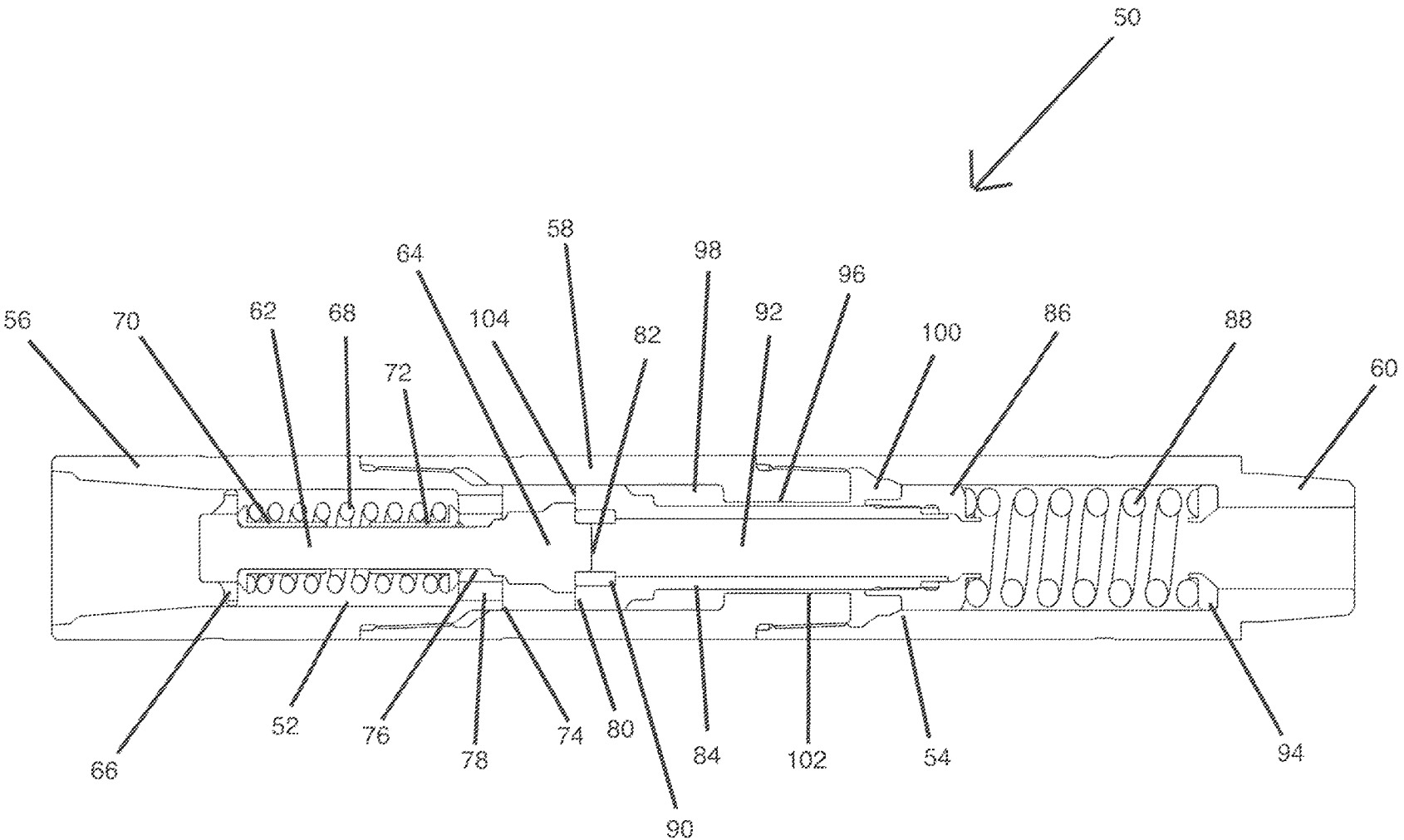
FIG. 8A is a sequential, cross-sectional view of another alternate extended reach tool with the valve in the closed position.

With reference now to FIG. 8A, extended reach tool 50 may include valve assembly 52 and shock absorbing assembly 54 disposed within upper housing 56, middle housing 58, and lower housing 60. Valve assembly 52 may include valve stem 62 extending to valve plunger 64. At its upper end, valve stem 62 may include one or more annular fluid passages 66. Valve assembly 52 may also include valve spring 68 disposed around valve stem 62. Upper stop sleeve 70 and lower stop sleeve 72 may be disposed around valve stem 62, with upper stop sleeve 70 within an upper portion of valve spring 68 and with lower stop sleeve 72 within a lower portion of valve spring 68. Lower end 74 of upper housing 56 may include central opening 76 and one or more annular fluid passages 78. Valve stem 62 may extend through central opening 76 of upper housing 56. Valve plunger 64 may include face 80 and guide protrusion 82.

Also with reference to FIG. 8A, shock absorbing assembly 54 may include piston 84, spring seat 86, and shock absorbing spring 88. Piston 84 may be designed following standard piston and housing guidelines for hydraulic systems. Wear sleeve 90 may be disposed within an upper end of central bore 92 of piston 84. Spring seat 94 may retain and align a lower end of shock absorbing spring 88 within lower housing 60. Shock absorbing assembly 54 may also include dampener 96 formed of first cavity 98, second cavity 100, and interconnecting annulus 102 between middle housing 58 and piston 84. Annulus 102 may have a gap thickness in the range of 0.001-0.100 inches. Alternatively, dampener 96 may be formed of an arrangement of orifices, each orifice having a diameter of 0.005-1 inch.

FIG. 8A illustrates tool 50 in a closed position in which plunger face 80 of valve plunger 64 contacts and creates a seal with piston face 104. Guide protrusion 82 of valve plunger 64 may extend into central bore 92 of piston 84.

Figure 8B:
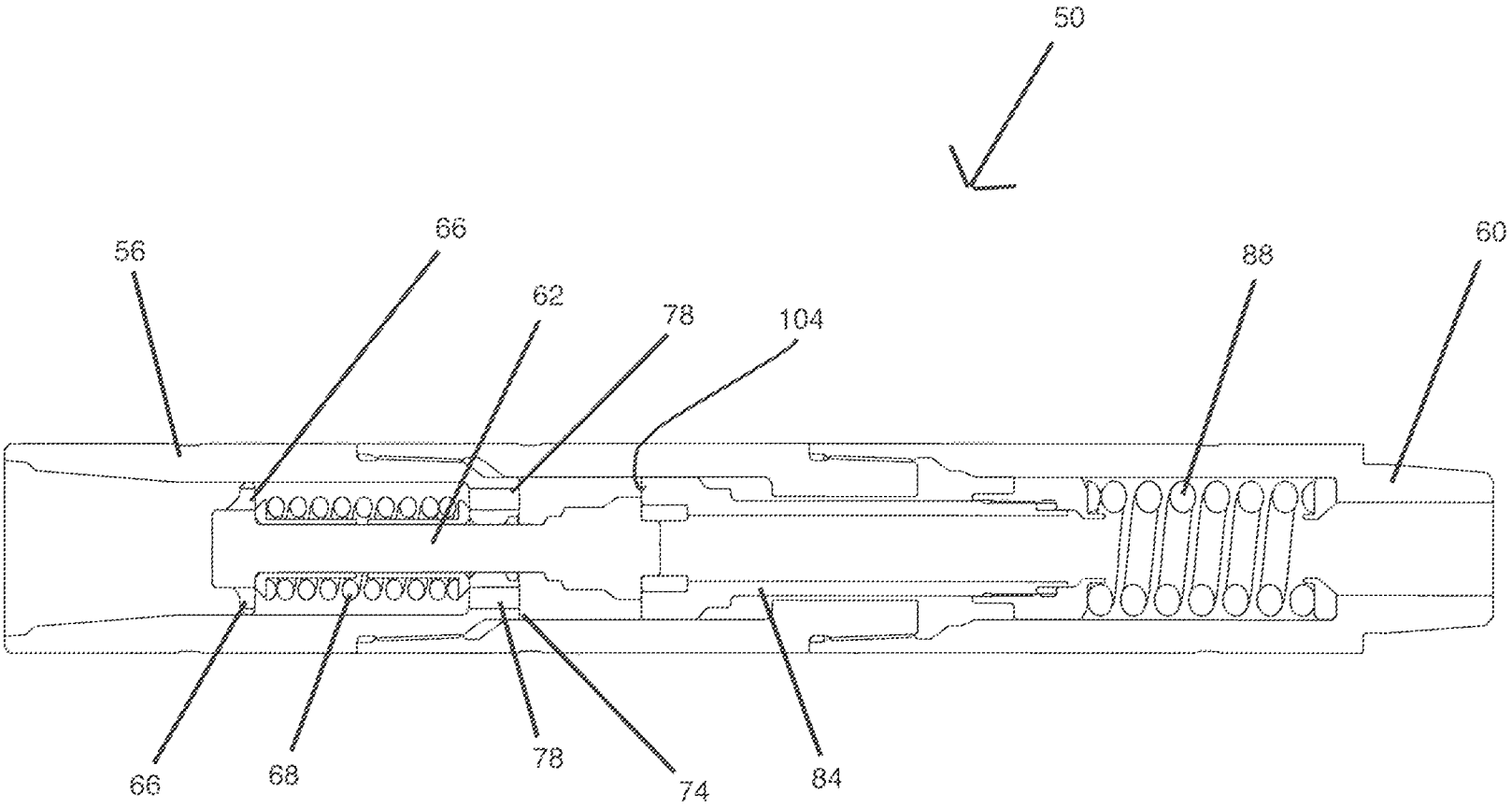
FIG. 8B is a sequential, cross-sectional view of the alternate extended reach tool with the valve stem and piston moving down simultaneously.

As seen in FIG. 8B, fluid flow in the central bore of upper housing 56 is diverted through fluid passages 66 of valve stem 62 and fluid passages 78 of lower end 74 of upper housing 56. The fluid flow may create a pressure differential between upper housing 56 and lower housing 60. The fluid pressure may act on an upper end of valve stem 62 and piston face 104, thereby moving valve stem 62 and piston 84 simultaneously downward (i.e., toward lower housing 60). Valve spring 68 is compressed as valve stem 62 moves downward, and shock absorbing spring 88 is compressed as piston 84 moves downward.

Figure 8C:
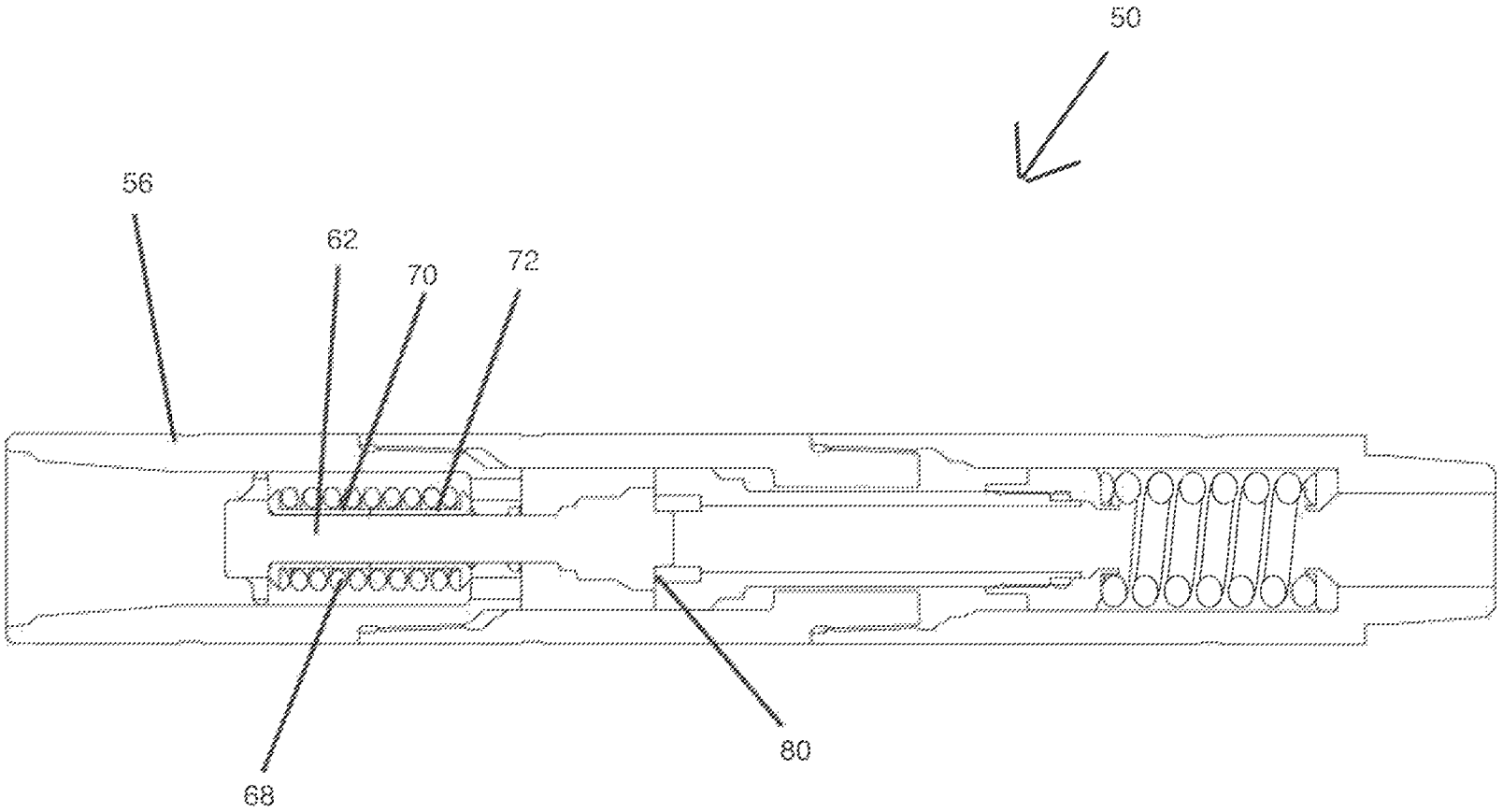
FIG. 8C is a sequential, cross-sectional view of the alternate extended reach tool with the valve stem contacting the spring stop.

With reference to FIG. 8C, the downward movement of valve stem 62 is stopped when upper stop sleeve 70 contacts lower stop sleeve 72. In this way, upper and lower stop sleeves 70 and 72 form a stop mechanism for valve stem 62. Alternatively, the stop mechanism for tool 50 may be any other mechanism for stopping the movement of valve stem 62. For example, upper housing 56 may include an inner shoulder configured to engage a portion of valve stem 62 to stop the downward movement of valve stem 62. In yet another alternate embodiment, tool 50 may function without a physical stop mechanism; instead, valve spring 68 may stop the movement of valve stem 62 when valve spring 68 reaches a force equilibrium between the spring force of valve spring 68 and the hydraulic forces caused by the differential pressure across the area of seal face 80 of valve stem 62.

Figure 8D:
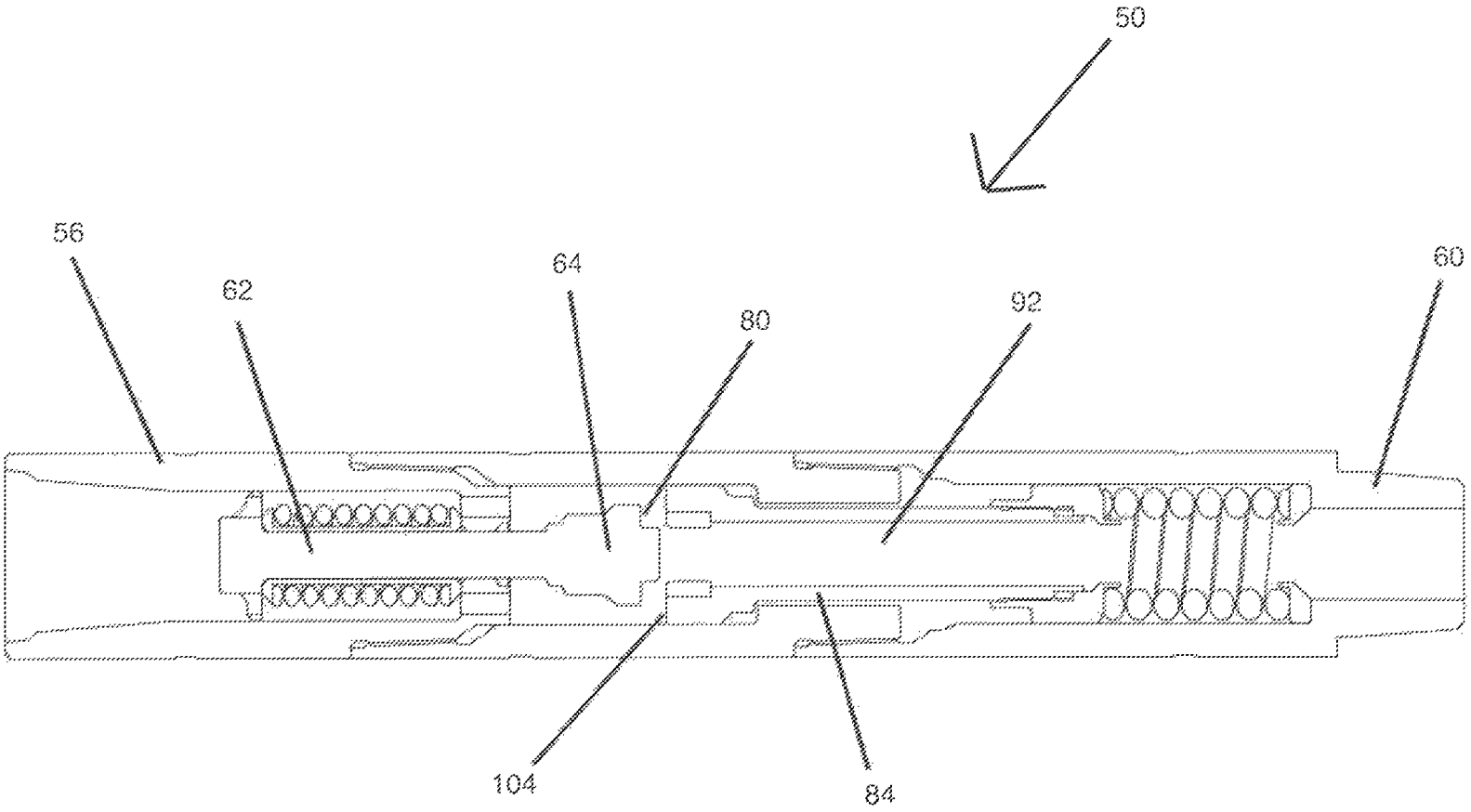
FIG. 8D is a sequential, cross-sectional view of the alternate extended reach tool with the piston continuing to move downward and creating a gap.

As seen in FIG. 8D, when valve stem 62 stops moving downward, piston 84 continues moving downward thereby creating an opening between face 80 of valve plunger 64 and piston face 104. Fluid may flow through this opening and through central bore 92 of piston 84 such that the pressure differential between upper housing 56 and lower housing 60 begins to decrease.

Figure 8E:
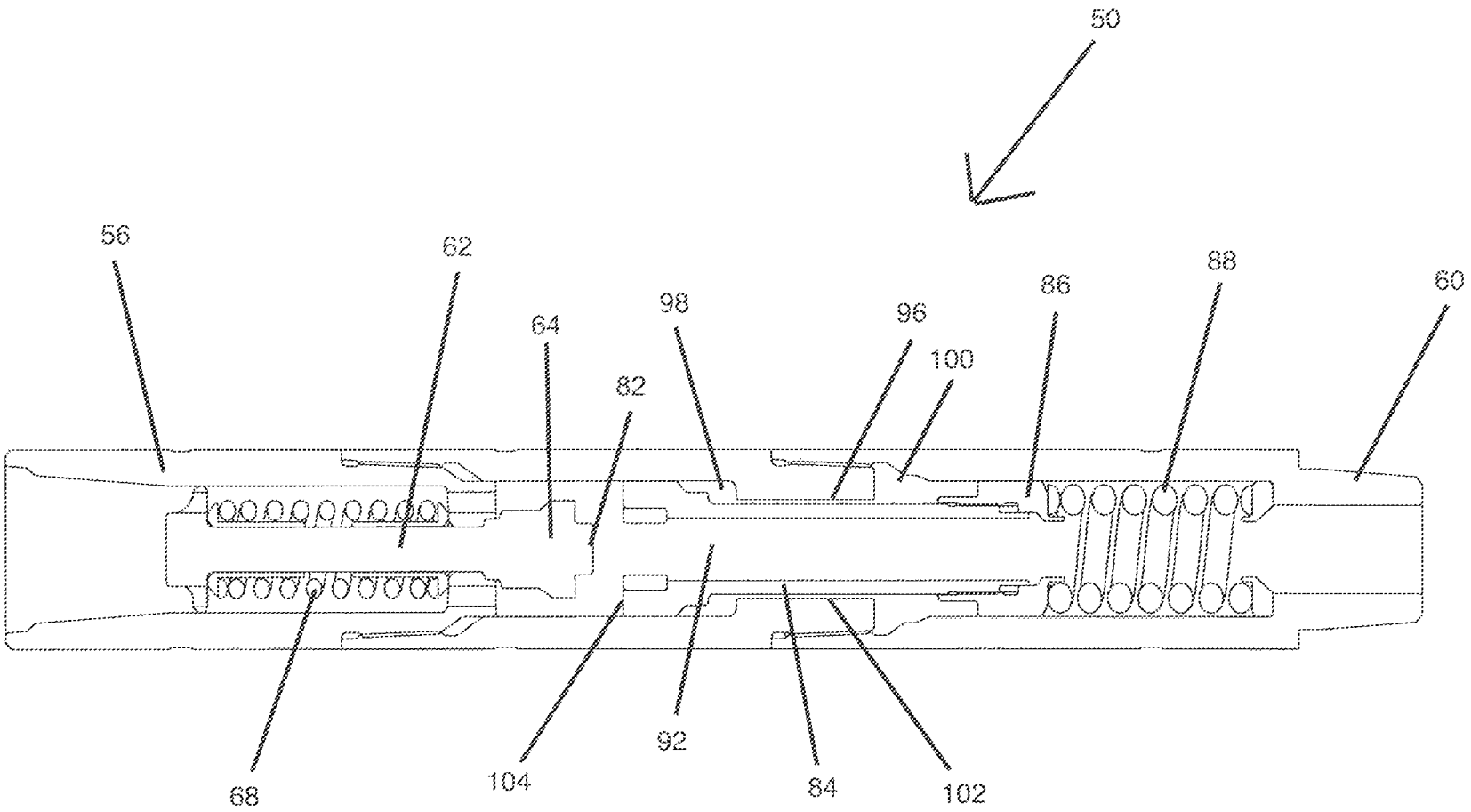
FIG. 8E is a sequential, cross-sectional view of the alternate extended reach tool with the valve stem and piston moving back up into the closed position.

Referring to FIG. 8E, as the pressure in upper housing 56 decreases, valve stem 62 begins to move upward due to the spring force of the compressed valve spring 68. When the downward movement of piston 84 compresses shock absorbing spring 88 to its defined compression limit, shock absorbing spring 88 moves piston 84 in an upward direction. Dampener 96 slows the upward movement of piston 84 by requiring spring seat 86 to force fluid contained in second cavity 100 through annulus 102 into first cavity 98 in order for piston 84 to move upward. The slower upward movement of piston 84 (relative to the upward movement of valve plunger 64) lengthens the time that the gap between valve plunger 64 and piston face 104 is open to fluid flow. In other words, dampener 96 reduces the frequency of the movement of piston 84 and the frequency of the pressure differential cycle.

Thereafter, valve plunger 64 and piston 84 return to the closed position as shown in FIG. 8A to create the fluid tight seal. When valve plunger 64 contacts piston face 104, guide protrusion 82 may engage central bore 92 of piston 84 to align valve plunger 64 to piston 84.

The movement cycle described above may be repeated to create a pressure pulse. A drill string above the extended reach tool expands when P1 or the pressure in upper housing 56 increases, and contracts when P1 or the pressure in upper housing 56 decreases. The dampener 96 of the extended reach tool controls the frequency of the pressure pulse. For example, the frequency of the pressure pulse may be in the range of 2-30 Hz.

Figure 9:
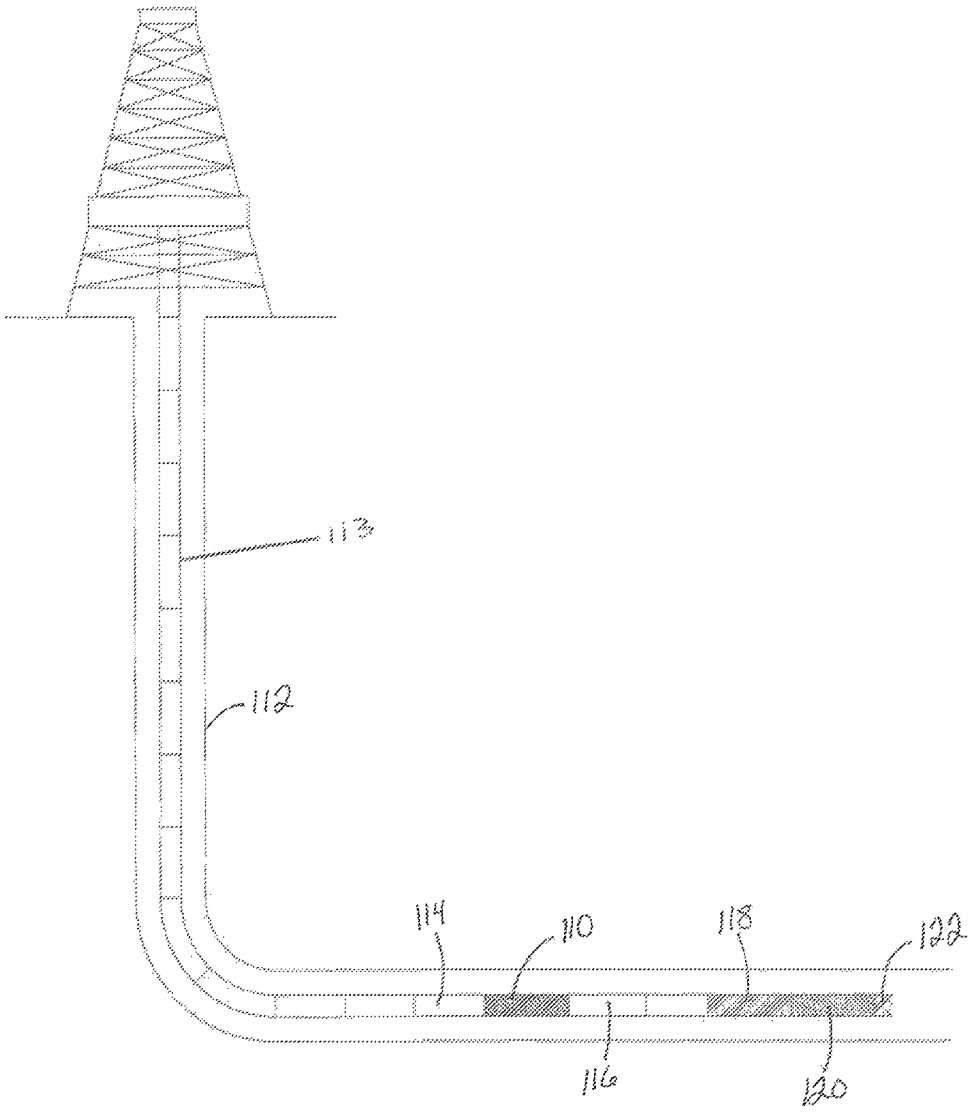
FIG. 9 is a schematic view of an extended reach tool in use with a drill pipe string in a wellbore.

FIG. 9 illustrates extended reach tool 110 installed on drill string 113 positioned within wellbore 112. Extended reach tool 110 may be disposed between drill pipe segments 114 and 116 of drill string 113, and above measurement-while-drilling component 118, drilling motor 120, and drill bit 122. Fluid pumped through the drill string causes extended reach tool 110 to create a pressure pulse in the drill pipe segments of drill string 113. The pressure pulse, in connection with a shock sub placed above the extended reach tool, reduces frictional forces between the drill pipe segments and wellbore 102, which allows drill bit 122 to drill wellbore 112 to a greater length than achieved with prior art devices. Extended reach tool 110 may function as tool 10, tool 40, or tool 50.

Figure 10:
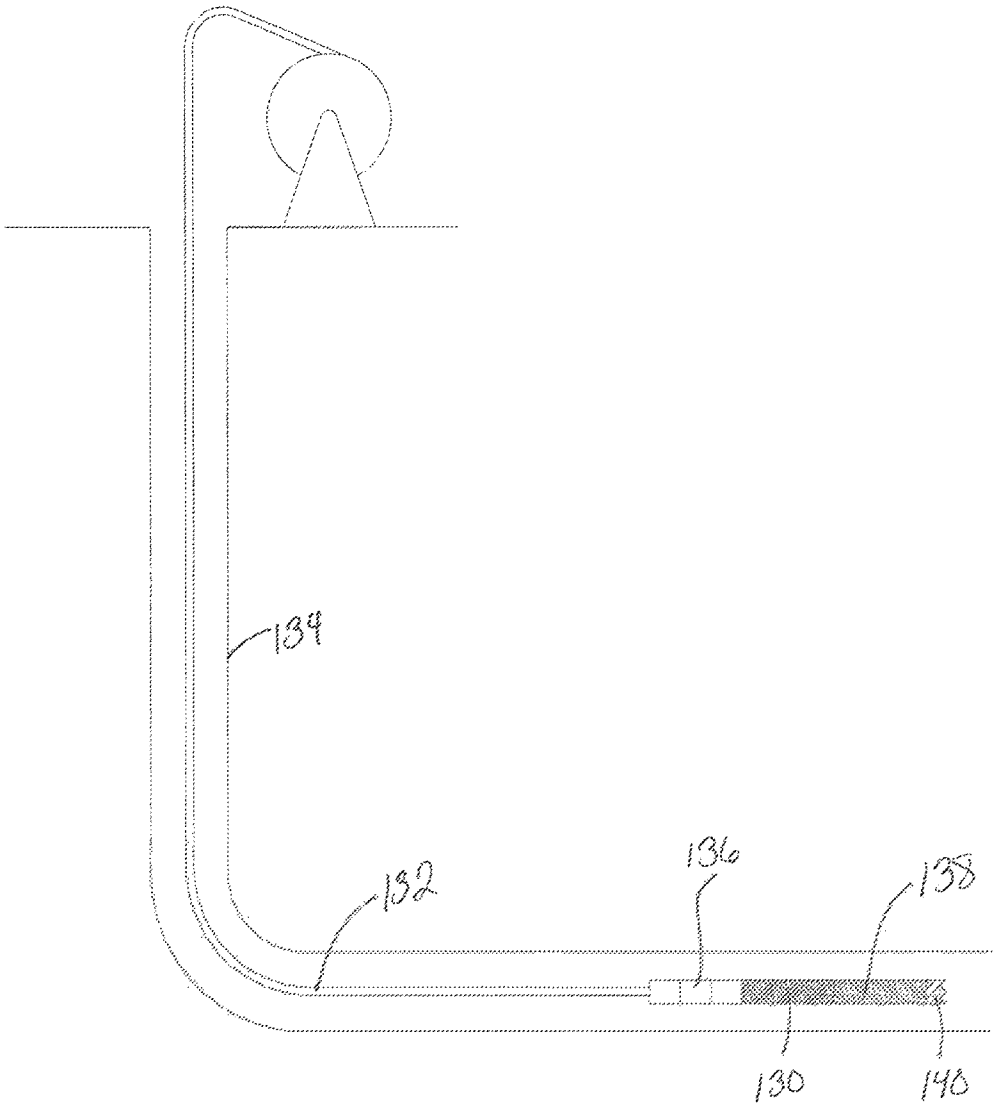
FIG. 10 is a schematic view of an extended reach tool in use with coiled tubing in a wellbore.

FIG. 10 illustrates extended reach tool 130 installed on coiled tubing line 132 positioned within wellbore 134. Extended reach tool 130 may be disposed below motor head assembly 136 and above drilling motor 138 and mill 140. Fluid pumped through coiled tubing line 132 causes extended reach tool 130 to create a pressure pulse in coiled tubing line 132. The pressure pulse stretches and reduces the length of the coil tubing line 132 thus reducing frictional forces and potential spiraling or helical buckling associated with using coiled tubing to reach a greater distance within wellbore 134. Extended reach tool 130 may function as tool 10, tool 40, or tool 50.

The arrangement of springs and openings in the extended reach tool described herein may be configured to generate an oscillating pressure pulse or a fluctuating differential pressure. The tool may achieve a pressure pulse with a lower frequency even with higher fluid flow rates due to the dampener of the shock absorbing assembly. The frequency of the pressure pulse generated by the extended reach tool is therefore less dependent on the fluid flow rate due to the dampener. In other words, the dampener can offset the effect of the flow rate fluctuation on the frequency of the pressure pulse by dampening the frequency of the pressure pulse. For example, the pressure pulse of the tool may be in the range of 2-30 Hz.

The disclosed extended reach tool is more efficient than prior art tools for generating pressure pulses with valves. The tool may not include any elastomers or seals. The extended reach tool may be designed to accommodate fluid flow in the form of drilling fluid or any other liquid or gas.

The extended reach tool described herein may be configured to be selectively activated downhole. For example, the extended reach tool may be configured to be attached to a drill string or a coiled tubing string, which is run into a wellbore with a drilling motor and a drill bit. A drilling fluid may be pumped through the drill string or coiled tubing string to cause the drill bit to further drill the wellbore. When frictional forces prevent the drill bit from progressing further, a first signal may be sent to the extended reach tool. The first signal may activate the extended reach tool, thereby causing the extended reach tool to vibrate the drill string or coiled tubing string. The vibration may reduce frictional forces and allow the drill bit to progress further, i.e., to drill the wellbore further. The vibrational action may be needed when drilling a lateral or horizontal bore. When vibration is no longer needed, a second signal may be sent to the extended reach tool. The second signal may deactivate the extended reach tool, thereby causing the extended reach tool to cease vibration of the drill string or coiled tubing string.

With reference to FIG. 9, extended reach tool 110 may be configured to be selectively activated. Extended reach tool 110 may be attached to drill string 113 positioned within wellbore 112. Selectively activated extended reach tool 110 may be disposed between drill pipe segments 114 and 116, and above measurement-while-drilling component 118, drilling motor 120, and drill bit 122. Drilling fluid pumped through drill string 113 may cause drilling motor 120 and drill bit 122 to drill further into wellbore 112. When frictional forces prevent or slow the movement of drill bit 122, a first signal may be sent to selectively activated extended reach tool 110. The first signal may activate selectively activated extended reach tool 110 such that it vibrates drill string 113 and the bottom hole assembly made up of the measurement-while-drilling component 118, drilling motor 120, and drill bit 122, to reduce the frictional forces, and to allow drill bit 122 to drill further into wellbore 113. If vibration of drill string 113 is no longer needed, a second signal may be sent to deactivate selectively activated extended reach tool 110.

With reference to FIG. 10, selectively activated extended reach tool 130 may be attached to coiled tubing line 132 positioned within wellbore 134. Selectively activated extended reach tool 130 may be disposed below motor head assembly 136 and above drilling motor 138 and mill 140. Drilling fluid pumped through coiled tubing line 132 and drilling motor 138 may cause drill bit 140 to drill further into wellbore 134. When frictional forces prevent or slow the movement of drill bit 140, a first signal may be sent to selectively activated extended reach tool 130. The first signal may activate selectively activated extended reach tool 130 such that it vibrates coiled tubing line 132 and the bottom hole assembly made up of the motor head assembly 136, the drilling motor 138 and the mill 140, to reduce the frictional forces, and to allow mill 140 to drill further into wellbore 134. If vibration of coiled tubing line 132 is no longer needed, a second signal may be sent to deactivate selectively activated extended reach tool 130.

The first signal and the second signal may be provided by any method of remotely activating a tool. In one embodiment, the signals may be provided by increasing or decreasing the flow rate of the drilling fluid above or below a threshold value. For example, a 2⅞ inch diameter selectively activated extended reach tool may have a threshold value of about 1 barrel per minute (bpm). The first signal may be provided by increasing the flow rate of drilling fluid through the selectively activated extended reach tool to any value over 1 bpm (e.g., 3-4 bpm). The second signal may be provided by decreasing the flow rate of drilling fluid through the selectively activated extended reach tool to any value below 1 bpm (e.g., 0.5-0.8 bpm). Alternatively, the signals may be provided by increasing or decreasing the rotary speed of the drill string above or below a threshold value.

In another embodiment, the signals may be provided by pumping a body (e.g., a ball, plug, or other component) with the drilling fluid. The body may be configured to cooperate with a receptacle in the selectively activated extended reach tool. Pumping a first body through the drill string or coiled tubing string and into the receptacle may activate the selectively activated extended reach tool to vibrate the drill string or coiled tubing string, and dropping a second body into the receptacle may deactivate the selectively activated extended reach tool.

In yet another embodiment, the selectively activated extended reach tool may include a control unit having a sensor, a battery, a processor, a CPU, and any other components necessary to sense the presence of signal units (e.g., RFID units) in the drilling fluid. The first signal and the second signal may be provided by pumping a signal unit with the drilling fluid. The control unit of the selectively activated extended reach tool may sense the presence of the signal units in the drilling mud, and may then activate the selectively activated extended reach tool to vibrate the drill string or coiled tubing string. The control unit may deactivate the selectively activated extended reach tool if it subsequently senses the presence of other signal units in the drilling mud.

Alternatively, the signals may be provided by a pressure pulse or pressure pulse sequence. In other embodiments, the signals may be provided by a hydraulic or electronic signal or a sequence of hydraulic or electronic signals that activate and deactivate the selectively activated extended reach tool.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. A downhole tool comprising:

a valve assembly including a valve spring operatively connected to a valve body; and a shock absorbing assembly including a spring operatively connected to a shock absorbing body having a fluid passage therethrough; and a dampener device operatively connected to the shock absorbing body for varying a movement speed of the shock absorbing body;

wherein the valve body is configured to selectively engage the shock absorbing body to create a fluid tight seal over the fluid passage in a first position and to allow a fluid flow through the fluid passage of the shock absorbing body in a second position, and wherein the selective engagement of the valve body and the shock absorbing body generates a varying pressure differential across the downhole tool; and wherein the varying of the movement speed of the shock absorbing body generates variable frequencies of the varying pressure differential across the downhole tool.

2. The downhole tool of claim 1, wherein the dampener device comprises a first chamber, a second chamber, and an interconnecting conduit.

3. The downhole tool of claim 2, wherein the interconnecting conduit comprises an annular space, an aperture or an arrangement of various apertures.

4. The downhole tool of claim 1, further comprising a stop mechanism for limiting a movement of the valve body.

5. The downhole tool of claim 4, wherein the stop mechanism comprises a shoulder configured to engage a portion of the valve body.

6. The downhole tool of claim 1, further comprising a housing, wherein the valve assembly and the shock absorbing assembly are disposed within the housing.

7. The downhole tool of claim 6, wherein the shock absorbing body comprises a piston.

8. The downhole tool of claim 7, wherein the valve body includes a valve stem extending to a valve plunger, wherein the valve plunger is configured to engage the shock absorbing body to seal the fluid passage in the first position.

9. The downhole tool of claim 8, wherein the valve spring is disposed around the valve stem and wherein a stop sleeve is disposed between the valve spring and the valve stem for limiting the compression of the valve spring.

10. The downhole tool of claim 8, wherein the valve plunger includes a guide protrusion, wherein the guide protrusion is at least partially disposed within the fluid passage of the shock absorbing body in the first position.

11. A method of generating a pressure pulse in a tubular disposed within a wellbore, comprising the steps of:

a) providing a downhole tool positioned in line with the tubular, wherein the down hole tool comprises: a valve assembly including a valve spring operatively connected to a valve body; a shock absorbing assembly including a spring operatively connected to a shock absorbing body having a fluid passage therethrough; and a dampener device operatively connected to the shock absorbing body for varying a movement speed of the shock absorbing body; wherein the valve body is configured to selectively engage the shock absorbing body to create a fluid tight seal over the fluid passage in a first position and to allow a fluid flow through the fluid passage of the shock absorbing body in a second position, wherein the selective engagement of the valve body and the shock absorbing body generates a varying pressure differential across the downhole tool; and wherein the varying of the movement speed of the shock absorbing body generates variable frequencies of the varying pressure differential across the downhole tool;

b) flowing a fluid through the tubular and into the downhole tool;

c) generating a pressure pulse with the downhole tool using the flow of the fluid to repeatedly move the valve body from the first position to the second position, wherein the fluid is prevented from flowing through the fluid passage in the first position, and wherein the fluid is allowed to flow through the fluid passage of the shock absorbing system in the second position.

12. A method of generating a pressure pulse in a tubular disposed within a wellbore, comprising the steps of:

a) providing an extended reach tool in a downhole assembly of the tubular, wherein the extended reach tool comprises: a valve assembly including a valve spring operatively connected to a valve body, and a shock absorbing assembly including a spring operatively connected to a shock absorbing body having a fluid passage therethrough, wherein the valve body is configured to selectively engage the shock absorbing body to create a fluid tight seal over the fluid passage in a first position and to allow a fluid flow through the fluid passage in a second position;

b) flowing a fluid through the tubular and into the extended reach tool; and c) generating a pressure pulse in the tubular with the extended reach tool with a repeated movement cycle of the valve body and the shock absorbing body between the first position and the second position, wherein the flow of the fluid through the extended reach tool powers the repeated movement cycle, wherein each movement cycle in step (c) includes:

i) allowing the flow of the fluid to move the valve body and the shock absorbing body in a first direction while maintaining the fluid tight seal of the first position, thereby compressing the valve spring and compressing the spring associated with the shock absorbing body;

ii) allowing the shock absorbing body to continue moving in the first direction when the valve body stops moving in the first direction to allow the fluid to flow through the fluid passage of the shock absorbing body;

iii) allowing the valve spring to move the valve body in a second direction opposite the first direction, and allowing the spring that is operatively connected to the shock absorbing body to move the shock absorbing body in the second direction; and iv) allowing the valve body and the shock absorbing body to return to the first position;

wherein the valve body stops moving in the first direction in step (ii) when the valve spring reaches a force equilibrium between a spring force of the valve spring and hydraulic forces acting on the valve body that are created by a pressure drop over one or more apertures in the valve body.

13. The method of claim 12, wherein the valve body stops moving in the first direction in step (ii) when a stop mechanism is engaged.

14. The method of claim 12, wherein the extended reach tool further comprises a dampener operatively connected to the shock absorbing body, and wherein in step (iii) the dampener causes the shock absorbing body to move in the second direction at a slower rate than the rate of movement of the valve body in the second direction.

15. A method of drilling a wellbore, comprising the steps of:

a) providing an extended reach tool in a downhole assembly of the tubular, wherein the extended reach tool comprises: a valve assembly including a valve spring operatively connected to a valve body, and a shock absorbing assembly including a spring operatively connected to a shock absorbing body having a fluid passage therethrough, wherein the valve body is configured to selectively engage the shock absorbing body to create a fluid tight seal over the fluid passage in a first position and to allow a fluid flow through the fluid passage in a second position; wherein the extended reach tool is configured to provide a vibration action in an activated state and to discontinue the vibration action in a deactivated state;

b) attaching the extended reach tool to a tubular and a drill bit;

c) lowering the extended reach tool and the tubular into a wellbore;

d) drilling the wellbore with the drill bit;

e) providing a first signal to the extended reach tool to cause a vibration of the tubular by (i) increasing a rotary speed of the tubular to exceed a threshold value to place the extended reach tool in the activated state, thereby vibrating the tubular or (ii) pumping a body through the extended reach tool, wherein the body cooperates with a receptacle to place the extended reach tool in the activated state.

16. The method of claim 15, further comprising the steps of:

f) providing a second signal to the extended reach tool to place the extended reach tool in the deactivated state, thereby discontinuing the vibration of the tubular.

17. The method of claim 16, wherein providing the first signal in step (e) includes increasing a rotary speed of the tubular to exceed a threshold value to place the extended reach tool in the activated state, and wherein providing the second signal in step (f) includes decreasing the rotary speed of the tubular to below the threshold value to place the extended reach tool in the deactivated state.

18. The method of claim 16, wherein providing the first signal in step (e) includes pumping a body through the extended reach tool, wherein the body cooperates with a receptacle to place the extended reach tool in the activated state, and wherein providing the second signal in step (f) includes pumping a second body through the extended reach tool, wherein the second body cooperates with the receptacle to place the extended reach tool in the deactivated state.

19. The method of claim 15, wherein the tubular is a drill string or coiled tubing.

* * * * *